US006755307B1

(12) United States Patent
Köhl

(10) Patent No.: US 6,755,307 B1
(45) Date of Patent: Jun. 29, 2004

(54) SEPARATING DEVICE COMPRISING A SCREEN LINING

(75) Inventor: Erich Köhl, Meerbusch (DE)

(73) Assignee: Metso Lindemann, Dusseldorf (DE)

( * ) Notice: Subject to any disclaimer, the term of this patent is extended or adjusted under 35 U.S.C. 154(b) by 187 days.

(21) Appl. No.: 10/018,279

(22) PCT Filed: May 31, 2000

(86) PCT No.: PCT/DE00/01799

§ 371 (c)(1),
(2), (4) Date: Apr. 1, 2002

(87) PCT Pub. No.: WO00/76679

PCT Pub. Date: Dec. 21, 2000

(30) Foreign Application Priority Data

Jun. 16, 1999 (DE) ..... 199 27 551

(51) Int. Cl.[7] ..... B07B 1/00
(52) U.S. Cl. ..... 209/264; 209/266; 209/392
(58) Field of Search ..... 209/264, 265, 209/266, 392, 393, 660, 674, 675, 679

(56) References Cited

U.S. PATENT DOCUMENTS

| | | | | | |
|---|---|---|---|---|---|
| 4,600 | A | * | 6/1846 | Church | 209/392 |
| 225,608 | A | * | 3/1880 | Hubbell | 209/392 |
| 750,167 | A | * | 1/1904 | Clement | 209/393 |
| 1,051,157 | A | * | 1/1913 | Owens | 209/316 |
| 1,068,302 | A | * | 7/1913 | Bodle | 209/393 |
| 1,190,067 | A | * | 7/1916 | Zenge | 198/445 |
| 2,295,190 | A | * | 9/1942 | Zenge et al. | 198/445 |
| 3,506,118 | A | * | 4/1970 | Illuzzi | 209/632 |
| 4,143,769 | A | | 3/1979 | Ripple | |
| 5,893,465 | A | * | 4/1999 | Harangozo | 209/674 |

FOREIGN PATENT DOCUMENTS

| | | |
|---|---|---|
| DE | 199 27 551 | 6/2000 |
| DE | 199 27 765 | 12/2000 |
| DE | 199 27 341 | 2/2001 |
| EP | 0 815 956 | 1/1998 |

* cited by examiner

*Primary Examiner*—Donald P. Walsh
*Assistant Examiner*—Joseph Rodriguez
(74) *Attorney, Agent, or Firm*—Norris, McLaughlin & Marcus

(57) ABSTRACT

A device for separating undesirable oblong and/or curved pieces of scrap from a scrap flow or scrap pile with a higher density, such as chill scrap, by means of an oscillating or shaking screen (1) includes a screen base (2) with a plurality of parallel guide bars (4) running in the longitudinal direction and a plurality of separating bars (3) which present openings (3.2) whose longitudinal and transverse cross-sections have different geometric shapes.

Figures 1, 2, 3, 4:
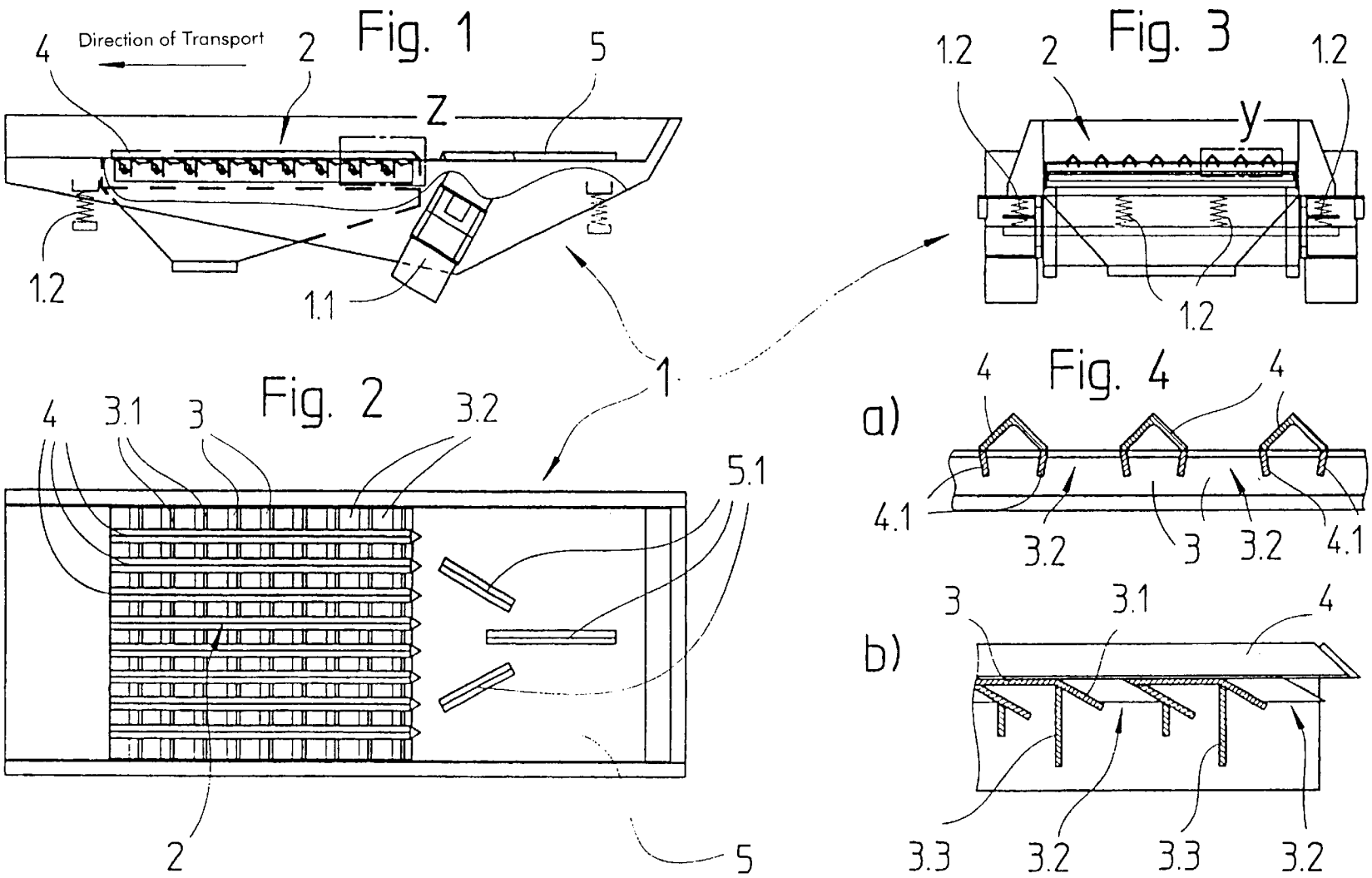

4 Claims, 1 Drawing Sheet a)
b)
Direction of Transport
1
1.1
1.2
2
3
3.1
3.2
3.3
4
4.1
5
5.1
Z
y

SEPARATING DEVICE COMPRISING A SCREEN LINING

FIELD OF THE TECHNOLOGY

BACKGROUND OF THE INVENTION

1. Field of the Invention

The invention relates to a device for separating undesirable oblong and/or curved pieces of scrap from a scrap flow or scrap pile having a higher density by means of an oscillating or shaking screen.

2. Description of the Related Art

DE 33 19 032 C2 describes a device for screen separation of a pile of metal chips containing undesirable oversized material by using an oscillating or shaking screen provided with transverse slits, wherein the screen base includes longitudinal channels extending in the transport direction. The longitudinal channels have a trough-shaped cross-section with a defined flank angle. Alternatively, the channel cross-section can also correspond to a isosceles triangle standing on its apex and having a defined apex angle.

This prior art invention makes possible a highly selective sorting of the oversized material and an essentially uniform bulk density of the screen through-fraction. The material to be screened and/or the oversized material is hereby initially oriented transverse to the direction of the screening slits so as to ensure a length-dependent through-fraction that can subsequent be pressed into dimensionally stable chip briquettes.

It may therefore seem obvious to utilize such device also for separating so-called fishes, i.e., undesirable oblong and/or curved scrap pieces of chill scrap, which represents a scrap metal flow with a higher density. However, the association in the latter scrap metal flow is different from that in a pile of metal chips containing undesirable oversized material.

Oblong or curved scrap metal pieces are undesirable in chill scrap because they negatively impact the flow characteristic of the material. Moreover, clusters with a smaller density can disadvantageously form in the feeder devices of steel plants where chill scrap is used. If this unsorted pile of chill scrap were fed to the aforedescribed screen separation device for the purpose of separation, then the desired effect would not occur, because the existing geometric form of the screen cover would make it impossible to separate the so-called fishes.

SUMMARY OF THE INVENTION

It is therefore an object of the invention to provide a suitable screen cover in a conventional oscillating or shaking screen to enable sorting of the so-called fishes from chill scrap, wherein the separation elements are formed and arranged so that, on one hand, the so-called fishes, i.e., the undesirable oblong and/or curved scrap metal pieces, are oriented and, on the other hand, are separated from the desired more rounded and more compact scrap metal pieces.

This object of the invention is accomplished by providing a device for separating undesirable oblong and/or curved pieces of scrap material from a scrap metal flow or scrap metal pile which has a higher density. Scrap metal with higher density are, for example, chill scrap. The separation is accomplished with a screen cover in an oscillating or shaking screen. The screen cover is made of a plurality of parallel guide bars running in a longitudinal direction and a plurality of parallel separating bars running in transverse direction, and, thus, forming a lattice-like frame with openings through which the material passes. The device provides a) guide bars which rest on separating bars and project over the separating bars, b) the guide bars are formed of angle stock include longitudinal rails that are formed on or continue from free legs of the angle stock, with their mutual separation on the free longitudinal sides being smaller than their separation at the free legs of the angle stock, so that—as seen in cross-section of the longitudinal rails—openings are formed which have a width that increases from top to bottom, and an essentially trapezoidal cross section, c) the transverse separating bars have flank strips which project into the openings and rise in the transport direction of the undesirable scrap metal pieces, so that—as seen in cross section of the separating bars—the openings have a cross section in the shape of a parallelogram, and d) the openings are thereby delineated both by the opposing longitudinal rails as well as by the opposing flank strips. Further, at least one rear wall is provided for each opening on the flank strip.

The invention will now be described in detail with reference to an embodiment illustrated in the drawing.

BRIEF DESCRIPTION OF THE INVENTION

FIG. 1 shows a longitudinal cross section through the screen tray arranged in an oscillating screen, FIG. 2 is a top view of FIG. 1, FIG. 3 is a transverse cross section of FIG. 1, and FIG. 4*a*) shows the detail y of FIG. 3, *b*) shows the detail z of FIG. 1.

DETAILED DESCRIPTION OF THE PRESENTLY PREFERRED EMBODIMENTS

As shown in FIGS. 1 to 3, a screen cover 2 in form of an essentially flat tray is arranged in an oscillating screen 1 with oscillation generators 1.1 and resilient supports 1.2. The delivery device for the scrap metal flow or scrap metal pile to be separated (not shown) is indicated in FIG. 1 by the arrow. It will be understood that the predominant fraction of rounded and denser scrap metal pieces passes through the openings 3.2 of the screen cover 2.

The screen cover 2 is formed as a grid-like frame consisting of several parallel separating bars 3 which extend transversely to the transport direction and several parallel guide bars 4 extending along the transport direction, wherein the guide bars 4 are positioned on top of the separating bars 3 and protrude laterally from the separating bars 3. In this way, shapes, cross-sections and openings 3.2 are formed, as shown in FIG. 4 which depicts the details of features y and z.

Arranged before the screen cover 2 is a closed flat base 5 with feed bars 5.1 which distribute the unsorted scrap metal flow. The effect intended by the object of the invention is a result of the simple, but experimentally verified and surprising feature: on one hand, the guide bars 4 which are advantageously formed of angle steel and rest on the separating bars 3, include flat longitudinal rails 4.1 formed on the free legs of the angle steel, with the free longitudinal sides of the longitudinal rails 4.1 being more closely spaced apart than the sides of the longitudinal rails 4.1 that are joined with the legs of the angle steel. As seen in FIG. 4*a*), openings 3.2 are formed which increase in width from the top to the bottom and have a trapezoidal cross section. On the other hand, the intended effect of the invention is achieved by providing the transverse separating bars 3 with flank strips

3.1 which project into the aforedescribed openings 3.2 and rise in the transport direction, so that according to FIG. 4*b*) the openings 3.2 have a cross section in form of a parallelogram. This different cross-sectional geometry essentially is responsible for the effect of the invention, the operation of which will be described hereinafter.

A chill scrap flow (not shown) containing essentially rounded scrap metal pieces (not shown) and interfering oblong and/or curved scrap metal pieces (not shown), i.e., the fishes, is placed on the base 5 and transported by the feed bars 5.1 onto the screen cover 2 whose construction was described before in detail.

On one hand, the guide bars 4 cause the oblong and/or curved scrap metal pieces, the fishes, in the chill scrap which flows in the transport direction to become oriented; on the other hand, the flank strips which are inclined in the transport direction, cause the rounded and denser scrap metal pieces to accumulate/pile up between the longitudinal rails 4.1, which in turn causes the fishes to "float." The different friction characteristic between the rounded scrap metal pieces and the oblong fishes assists in the "float" and produces the desired separation effect. The openings 3.2 which increase in width downwardly and are formed by the longitudinal rails 4.1 prevent jamming of the rounded scrap metal pieces that pass through the openings 3.2. The flank strips 3.1 of the separating bars 3 prevent the undesirable fishes, which are also curved, from slowing down and/or becoming entangled. The fishes therefore can "swim" across the screen cover 2 to the discharge end. The openings 3.2 formed according to the invention prevent jamming in the transport direction and, more particularly, entanglement of the fishes. An additional rear wall 3.3 counteracts the tendency of long scrap metal pieces to reach the openings 3.2, which can occur when the typically forwardly moving fishes start to move in the reverse direction during operation.

INDUSTRIAL APPLICABILITY

The advantageous construction according to the invention and the cost-efficient fabrication of the separation elements ensure industrial applicability of the device and economic success for separating undesirable scrap metal pieces.

What is claimed is:

1. A device for separating undesirable pieces of scrap from a flow of scrap metal in a transport direction, the device comprising:

an oscillating screen including a screen cover, the screen cover comprising a plurality of substantially parallel guide bars arranged in a substantially longitudinal direction and a plurality of substantially parallel separating bars arranged in a substantially transverse direction, the plurality of guide bars and the plurality of separating bars form a lattice-like frame with openings through which material passes, the plurality of guide bars resting on and projecting over the plurality of separating bars, the plurality of guide bars being formed of angle stock forming legs with longitudinal rails being connected to respective free terminating ends of the legs of the angle stock, free terminating ends of the longitudinal rails being separated by a distance smaller than that between terminating ends of the legs of the angle stock at its interface with the respective longitudinal rails so that the openings formed have a width that increases from top to bottom and a substantially trapezoidal transverse cross section, the plurality of separating bars having flank strips which project into the openings and rinse in the transport direction of the undesirable pieces of scrap so that the openings have a longitudinal cross section in the shape of a parallelogram, and the openings are delineated by opposing longitudinal rails and by opposing flank strips.

2. The device of claim 1, wherein at least one rear wall is provided for each opening on the flank strip.

3. The device of claim 1, wherein the scrap metal is chill scrap.

4. The device of claim 1, wherein the undesirable pieces are at least one of oblong pieces and curved pieces.

* * * * *